US008465261B2

(12) United States Patent
Holzschuh

(10) Patent No.: US 8,465,261 B2
(45) Date of Patent: Jun. 18, 2013

(54) TURBOCHARGER

(75) Inventor: Christian Holzschuh, Fellbach (DE)

(73) Assignee: BorgWarner Inc., Auburn Hills, MI (US)

( * ) Notice: Subject to any disclaimer, the term of this patent is extended or adjusted under 35 U.S.C. 154(b) by 927 days.

(21) Appl. No.: 12/517,389

(22) PCT Filed: Oct. 23, 2007

(86) PCT No.: PCT/EP2007/009193

§ 371 (c)(1),
(2), (4) Date: Jun. 3, 2009

(87) PCT Pub. No.: WO2008/071253

PCT Pub. Date: Jun. 19, 2008

(65) Prior Publication Data

US 2010/0003132 A1 Jan. 7, 2010

(30) Foreign Application Priority Data

Dec. 11, 2006 (DE) ..... 10 2006 058 339

(51) Int. Cl.
*F01D 25/00* (2006.01)

(52) U.S. Cl.
USPC ..... 416/213 R; 416/204 A; 416/244 A

(58) Field of Classification Search
USPC ..... 416/204 A, 213 R, 244 A, 244 R
See application file for complete search history.

(56) References Cited

U.S. PATENT DOCUMENTS

| | | | | |
|---|---|---|---|---|
| 3,961,867 | A * | 6/1976 | Woollenweber | 417/407 |
| 4,408,959 | A * | 10/1983 | Long et al. | 416/241 B |
| 4,778,345 | A * | 10/1988 | Ito et al. | 416/241 B |
| 4,991,991 | A * | 2/1991 | Ito et al. | 403/30 |
| 5,176,497 | A | 1/1993 | Deacon et al. | |
| 2002/0001522 | A1 | 1/2002 | Mukherjee et al. | |
| 2004/0057834 | A1 * | 3/2004 | Shimizu | 416/244 A |
| 2010/0003132 | A1 * | 1/2010 | Holzschuh | 415/230 |

FOREIGN PATENT DOCUMENTS

| | | | |
|---|---|---|---|
| EP | 1394387 | A2 | 3/2004 |
| JP | 57093606 | A * | 6/1982 |
| WO | 9907982 | A1 | 2/1999 |
| WO | 2006051285 | A1 | 5/2006 |

OTHER PUBLICATIONS

English abstract of JP57093606A from Espacenet (EPO).*

* cited by examiner

*Primary Examiner* — Edward Look
*Assistant Examiner* — Christopher R Legendre
(74) *Attorney, Agent, or Firm* — William G. Anderson; Stephan A. Pendorf; Patent Central LLC

(57) ABSTRACT

The invention refers to a turbocharger with a compressor (8) which has a compressor wheel (9) which is fixed on one end of a rotor shaft (6); with a turbine (2) which has a turbine rotor (10) which comprises a turbine wheel (5) which has a connecting journal (17) which can be connected to a connecting section (12) of the rotor shaft (6), and with at least one piston ring groove (11, 11') which is provided on the turbine rotor (10); wherein the piston ring groove (11, 11') is arranged on the connecting journal (17).

5 Claims, 1 Drawing Sheet

TURBOCHARGER

FIELD OF THE INVENTION

The invention refers to a turbocharger.

BACKGROUND OF THE INVENTION

A generic-type turbocharger is known from EP 1 621 774 A2.

In the case of such turbochargers the piston ring grooves or slots were always arranged in the rotor shaft. In this case, it is possible that one slot per piston ring is provided, or that two piston rings are arranged in one slot. Since the piston ring slot next to the turbine wheel requires a constructional minimum distance from the turbine wheel and the connecting journal on the turbine wheel back is kept axially as short as possible, it has not been possible up to now to introduce two slots in the shaft region without weakening the shaft in cross section or without axially extending the shaft, which has the consequence of very negative effects upon the rotor bearing stability. If the turbine wheel and the rotor shaft are connected by means of a weld, it has not been possible up to now to position the piston ring slots in any desired manner since the region of the weld point is not suitable for the locating of the slots on account of inconsistent material properties.

SUMMARY OF THE INVENTION

It is consequently the object of the present invention to create a turbocharger for an internal combustion engine, which has a turbine rotor which, without increasing the axial rotor length, enables the avoidance of strength reductions of the arrangement as a result of the locating of piston ring slots.

Such an object can be achieved by a turbocharger according to embodiments herein. The turbocharger has a compressor with a compressor wheel which is fixed on one end of a rotor shaft. The turbocharger has a turbine with a turbine rotor, which comprises a turbine wheel which has a connecting journal that is connected to a connecting section of the rotor shaft. Two or more piston ring grooves are arranged on the connecting journal of the turbine rotor. The connecting journal of the turbine wheel has a cylindrical cavity. The depth of the cavity is smaller than a length of the connecting journal, measured from an axial shaft-side end face of the rotor shaft to a wheel back of the turbine wheel. This object may also be achieved by a turbine rotor of a turbocharger according to embodiments herein. The turbine rotor has a turbine wheel, which has a connecting journal that is connected to a connecting section of a rotor shaft. At least one piston ring groove is arranged on the connecting journal.

Therefore, with design of the turbine wheel according to the invention, it is possible to completely integrate a multiplicity of necessary piston ring grooves into the material of the turbine wheel. As a result, the disadvantages of the prior art are avoided. The advantage of the design according to the invention is that all the piston ring grooves on the one hand lie in the material which is more resistant to heat compared with the material of the rotor shaft, and on the other hand are correspondingly positioned at a distance from the connecting plane between rotor shaft and turbine wheel, from which an increase of strength of the entire turbine rotor results.

Further details, advantages and features of the invention result from the following description of an exemplary embodiment and from the drawing.

DETAILED DESCRIPTION OF THE INVENTION

Figure 1:
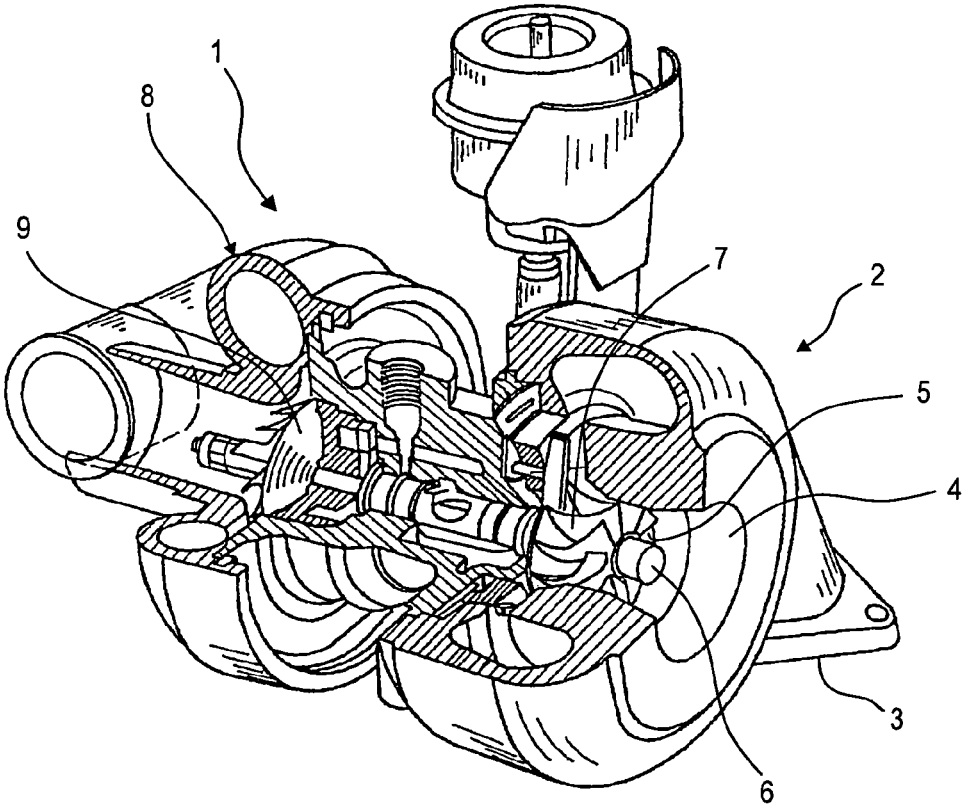
FIG. 1 shows a partially broken-open perspective view of the turbocharger according to the invention.

In FIG. 1, a turbocharger 1 according to the invention is illustrated in a partially broken-open view.

The turbocharger 1 has a turbine 2 which comprises an exhaust gas inlet opening 3 and an exhaust gas discharge opening 4.

Furthermore, a turbine wheel 5, which is fastened on one end of a rotor shaft 6, is arranged in the turbine housing of the turbine 2.

A multiplicity of blades, of which only the blade 7 is to be seen in FIG. 1, is arranged in the turbine housing between the exhaust gas inlet opening 3 and the turbine wheel 5.

Furthermore, the turbocharger 1 has a compressor 8 which comprises a compressor wheel 9 which is fastened on the other end of the rotor shaft 6 and is arranged in the compressor housing of the compressor 8.

Naturally, the turbocharger 1 according to the invention also has all the other customary components of a turbocharger, such as a bearing housing with a bearing housing unit, etc, which, however, are not subsequently described since they are not necessary for the explanation of the principles of the present invention.

Figure 2:
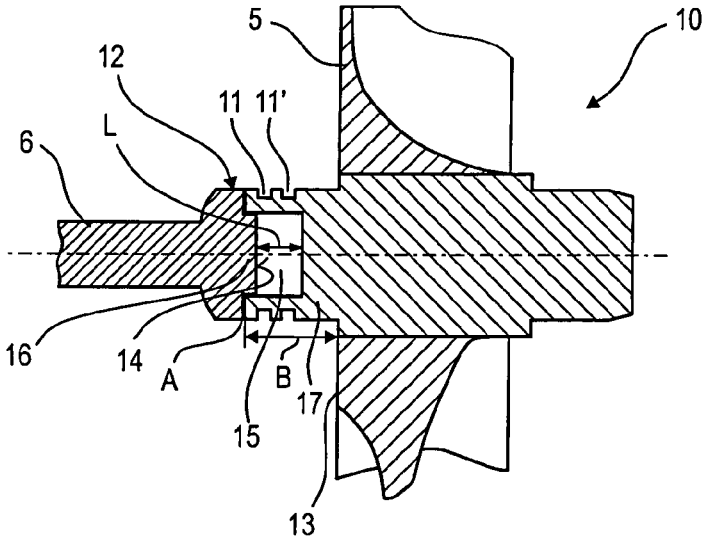
FIG. 2 shows a cross-sectional view of the turbine rotor with two piston ring grooves.

In FIG. 2, a part of a turbine rotor 10 is shown in section, which shows the rotor shaft 6 and the turbine wheel 5 with the arrangement according to the invention of piston ring grooves 11, 11' on an extended one-piece connecting journal 17 of the turbine wheel 5. As a result of this design of the turbine wheel 5 the effect is achieved of all constructionally necessary piston ring grooves 11, 11' being formed in the material of the turbine wheel 5 which is more resistant to heat compared with the material alloy of the rotor shaft 6. This arrangement of the piston ring grooves 11, 11' in identical material creates identical tribological conditions for the piston rings (which are not shown in this figure) which are to be inserted therein. The position of the piston ring grooves 11, 11' and also the essential distance of the connecting plane A between the rotor shaft 6 and the first piston ring groove 11, which is apparent in FIG. 2, increases the strength of the entire arrangement of the turbine rotor 10 to a high degree. Disadvantageous influences as a result of the joining process for connecting the rotor shaft 6 and the turbine wheel 5, such as a lower hardness or hardness peaks at the piston ring grooves 11, 11', can therefore largely be eliminated compared with the prior art.

As also apparent from the sectional drawing in FIG. 2, the turbine wheel 5 has a cylindrical cavity 15, the depth L of which, measured from the axial shaft-side end face 14 of the connecting journal 17 to a wheel back 13 of the turbine wheel 5, is less than a length B of the connecting journal 17.

The rotor shaft 6 and the turbine wheel 5 can be interconnected on the connecting plane A either by means of friction welding or electron-beam welding. As is apparent from the drawing of FIG. 2, the rotor shaft 6 has a short shaft stub 16. For the joining process by means of electron-beam welding, the design according to the invention of the connecting journal 17 of the turbine wheel 5 has the advantage that this can be simply pressed onto the shaft stub 16, and the risks of stresses occurring during the welding process, and possible crack developments as a consequence of it as result of the material thicknesses or wall thicknesses which exist on the connecting plane A on the two components, can be minimized.

For amplification of the disclosure, the illustration of the invention in FIGS. 1 and 2 is explicitly referred to.

LIST OF DESIGNATIONS

1 Turbocharger/exhaust gas turbocharger
2 Turbine
3 Exhaust gas inlet opening
4 Exhaust gas discharge opening
5 Turbine wheel
6 Rotor shaft
7 Blades
8 Compressor
9 Compressor wheel
10 Turbine rotor
11, 11' Piston ring groove
12 Connecting section
13 Wheel back
14 Shaft-side end face
15 Cavity
16 Shaft stub
17 Connecting journal
20 A Connecting plane
L Depth of the cavity (of the recess)
B Length of the connecting journal

The invention claimed is:

1. A turbocharger (1) comprising:

a compressor (8), which has a compressor wheel (9) which is fixed on one end of a rotor shaft (6);

a turbine (2), which has a turbine rotor (10), which comprises a turbine wheel (5) which has a connecting journal (17) which is connected to a connecting section (12) of the rotor shaft (6); and at least two piston ring grooves (11, 11'), arranged on the connecting journal (17) of the turbine rotor (10), wherein the connecting journal (17) of the turbine wheel (5) has a cylindrical cavity (15), the depth (L) of which is smaller than a length (B) of the connecting journal (17), measured from an axial shaft-side end face (14) of the rotor shaft (6) to a wheel back (13) of the turbine wheel (5), and wherein the piston ring grooves (11, 11') surround the cavity (15).

2. The turbocharger as claimed in claim 1, wherein a connecting plane (A) is arranged between the rotor shaft (6) and the turbine wheel (5) at a axial distance to the nearest piston groove (11, 11').

3. The turbocharger as claimed in claim 1, wherein the turbine wheel (5) and the rotor shaft (6) are connected by means of a friction weld or by means of an electron beam weld.

4. A turbine rotor (10) of a turbocharger (1) comprising:

a turbine wheel (5), which has a connecting journal (17) which is configured for connection to a connecting section (12) of a rotor shaft (6), the connecting journal (17) having a cavity (15) for receiving a portion of the rotor shaft (6), the connecting journal (17) extending from the turbine wheel (5) to an end, wherein at least one piston ring groove (11, 11') is arranged on the connecting journal (17) proximate to the end thereof, the at least one piston ring groove (11, 11') surrounding the cavity (15).

5. A turbine rotor (10) of a turbocharger (1) comprising:

a turbine wheel (5) which has a connecting journal (17) connected to a connecting section (12) of a rotor shaft (6), and at least two piston ring grooves (11, 11') arranged on the connecting journal (17) of the turbine rotor (10), wherein the connecting journal (17) of the turbine wheel (5) has a cylindrical cavity (15), the depth (L) of which is smaller than a length (B) of the connecting journal (17), measured from an axial shaft-side end face (14) of the rotor shaft (6) to a wheel back (13) of the turbine wheel (5), and wherein the piston ring grooves (11, 11') surround the cavity (15).

* * * * *